United States Patent [19]

Plourde et al.

[11] 4,178,111

[45] Dec. 11, 1979

[54] APPARATUS FOR THE EXCAVATION OF SUBTERRANEAN TUNNELS

[76] Inventors: Fernand Plourde, 111 Westwood Ave., Plainville, Conn. 06062; Maurice Plourde, 45 Wakeley Rd., Newington, Conn. 06111

[21] Appl. No.: 938,114

[22] Filed: Aug. 30, 1978

[51] Int. Cl.[2] ..... E21D 9/06

[52] U.S. Cl. ..... 405/142; 299/31; 405/145; 299/56

[58] Field of Search ..... 405/138, 140, 142, 143, 405/144, 145, 146; 299/31, 33, 56, 87, 64; 198/513

[56] References Cited

U.S. PATENT DOCUMENTS

| | | | |
|---|---|---|---|
| 1,317,586 | 9/1919 | Mack | 299/56 |
| 1,336,440 | 4/1920 | O'Toole | 299/87 X |
| 3,088,718 | 5/1963 | Lilly | 299/64 X |
| 3,309,142 | 3/1967 | Winberg | 299/33 |
| 3,355,215 | 11/1967 | Haspert et al. | 299/56 X |
| 3,382,002 | 5/1968 | Tabor | 405/143 X |
| 3,556,599 | 1/1971 | Fikse | 405/141 X |
| 3,919,851 | 11/1975 | Plourde | 405/146 X |
| 3,962,803 | 6/1976 | O'Brien | 299/87 X |
| 3,997,216 | 12/1976 | Russell | 198/513 X |

*Primary Examiner*—Dennis L. Taylor
*Attorney, Agent, or Firm*—McCormick, Paulding & Huber

[57] ABSTRACT

Tunnel excavating apparatus comprises a hollow cylindrical shield adapted to be axially forced through subterranean material and having a circular cutting edge at a leading end portion. An inclined baffle and guide member has a central opening spaced upwardly from a lower edge of the baffle and guide member and an auger-like member extends across the shield adjacent the opening. Sections of the auger-like member extending on horizontally opposite sides of the baffle opening have oppositely directed flutes and subterranean material dislodged by the cutting edge and deposited atop and about the auger is urged inwardly toward the opening in the baffle and guide member for deposition on a conveyor having a receiving end beneath the opening. The conveyor extends rearwardly and upwardly and deposits the material in a receptacle. Horizontal and vertical breasting plates also serve to cut and dislodge material and support the shield. A rotary cutter above the auger-like member also assists in cutting the subterranean material. The cutter is movable from a position within the shield to a position forwardly of its cutting edge.

10 Claims, 3 Drawing Figures

APPARATUS FOR THE EXCAVATION OF SUBTERRANEAN TUNNELS

BACKGROUND OF THE INVENTION

This invention relates to tunneling apparatus generally and, more particularly, to tunneling apparatus of the type disclosed in U.S. Pat. No. 3,919,851 granted Nov. 18th, 1975 entitled "Apparatus for the Excavation and Lining of Subterranean Tunnels." The tunneling apparatus disclosed in the patent comprises a plurality of hollow cylindrical shields arranged in end-to-end coaxial relationship with the cutting and/or steering shield in a forwardmost position. An intermediate shield may be provided between the cutting shield and a power shield in a rearwardmost position. Heavy duty power jacks disposed circumaxially within the power shield urge the intermediate and the cutting shield forwardly to advance the cutting edge of the latter through subterranean material. Steering jacks may also be provided to provide for slight angular displacement of the cutting shield from its coaxial relationship and thus provide for steering of the entire assembly as it proceeds through subterranean material.

Subterranean material dislodged by the cutting edge of the forwardmost or cutting shield is deposited within a leading end portion of the shield and, in accordance with conventional practice, the material is removed manually through the cutting shield, the intermediate shield, and the power shield in a rearward direction. Obviously, the material removal operation is a relatively slow and tedious process and has a detrimental effect on the overall rate of movement of the shield assembly through the subterranean material.

It is the general object of the present invention to provide for the collection and rearward transport of subterranean material dislodged by the cutting edge of a cutting shield and deposited within the leading end portion of the shield.

A further object of the invention resides in the provision of the horizontally extending auger-like member which operates to draw dislodged material laterally inwardly to a central location for deposit on a rearwardly moving conveyor means.

A still further object resides in the provision of an auger-like member of the type mentioned which cooperates with a guide and baffle means for the efficient collection of dislodged material, the lateral inward transport of the same, and the efficient deposition of the same on the receiving end of a rearwardly extending conveyor means.

A still further object of the invention resides in the provision of a horizontally extending rotary cutter disposed above the auger-like member and adapted to aid in the dislodgement of subterranean material and the deposition of the same within the leading end portion of the cutting shield for further operation thereon by the augar-like member.

A still further object of the invention resides in the provision of a rotary cutter element of the type mentioned which is movable generally axially from a position within the cutting shield to a position forwardly thereof.

SUMMARY OF THE PRESENT INVENTION

In fulfillment of the foregoing objects, apparatus for the excavation of subterranean tunnels comprises a hollow cylindrical shield adapted to be axially forced through subterranean materials and having a circular cutting edge at a leading end portion. An inclined baffle and guide member extends across a lower portion of the shield internally and rearwardly of its cutting edge, the inclination of the member being rearwardly and upwardly with respect to a lower portion of the cutting edge and the lower edge of the member being arcuate to substantially fit the internal parti-circular contour of the shield. An opening is provided in the baffle and guide member approximately at its center and is spaced upwardly and rearwardly from its lower edge. An auger-like member rotates about a substantially horizontal axis and is disposed internally across the shield rearwardly of its cutting edge and above the baffle and guide member adjacent the opening in the member. First and second similar but opposite sections extending on horizontally opposite sides of the baffle opening and having oppositely directed flutes cause the auger-like member to transport and to direct subterranean material dislodged by the cutting edge horizontally inwardly in opposite directions. The material so transported discharges downwardly through the opening in the baffle and guide member for further transport and removal rearwardly beneath the baffle and guide member and from the interior of the shield.

Preferably a conveyor means is provided for the rearward transport and removal of the dislodged subterranean material and has a receiving end disposed beneath the opening in the baffle and guide member. Thus, the dislodged material is deposited vertically through the opening onto the conveyor means and a material transporting surface on the conveyor means extends rearwardly within the shield for the removal of the material from the shield. With a rear end portion of a conveyor means elevated, a material receptacle may be positioned therebeneath for discharge of the material thereto and for further rearward transport and removal.

The leading end portion of the cutting shield preferably also included "breasting plates" which may comprise two or more horizontally arranged plates and one or more vertically arranged plates. The breasting plates provide a support function for the shield and they also have their leading edges adapted with cutting edges for further action in dislodging the subterranean material as the shield is forced axially through the material.

An optional rotary cutter element disposed above the auger-like member and extending substantially across the leading end portion of the shield has suitable power drive means and is movable between positions in the interior of the shield and forwardly of the cutting edge on the shield. Material dislodged by the rotary cutting element falls upon the auger-like member or the baffle and guide member for operation by the auger-like member and the collection and transport process through the opening in the baffle and guide member.

DESCRIPTION OF THE PREFERRED EMBODIMENT

Figure 1:
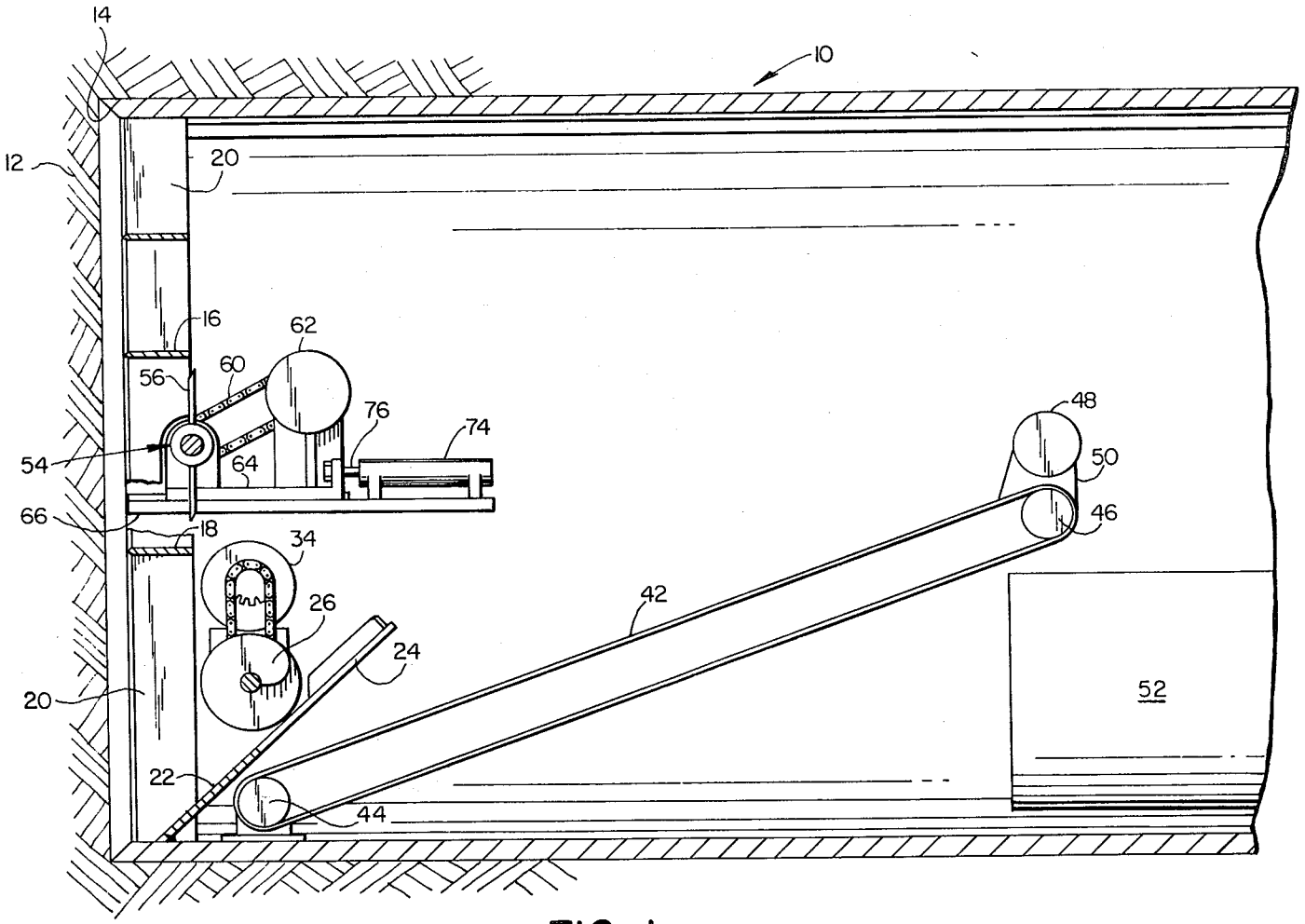
FIG. 1 of the drawings is a somewhat schematic vertical section view through the tunneling apparatus of the present invention and illustrating a cutting shield, auger-like member, baffle and guide means, conveyor means, rotary cutter element, etc.

Referring particularly to FIG. 1, it will be observed that the tunneling apparatus of the present invention comprises a hollow cylindrical shield 10 which may be of a diameter allowing workmen to stand erect therewithin and which is of heavy steel construction fabricated in welding, riveting operations, etc. The shield 10 may be the forwardmost shield in a series of shields arranged in end-to-end coaxial relationship with a power shield therebehind, or with an intermediate shield and a power shield behind the latter as in the above-mentioned U.S. patent. The shield 10 may also serve a steering function as it is urged leftwardly in FIG. 1 for axial advancement through subterranean material 12. At its front or leading end portion a circular cutting edge 14 is provided to cut and dislodge the subterranean material 12 as the shield is advanced. Advancement of the shield is incremental with heavy duty power jacks operating in the power shield and when an advancing movement of the shield is terminated the dislodged subterranean material within the leading end portion of the shield 10 is removed rearwardly through the interior of the shield.

The leading end portion of the shield 10 may also be provided with "breasting plates" and two (2) such plates are shown at 16, 18 in horizontal attitude and extending across the interior of the shield. A vertical breasting plate 20 may support the horizontal breasting plates 16, 18 and each of the breasting plates may be provided with a cutting edge for assistance in dislodging the subterranean material 12 during shield advancement.

Figure 2:
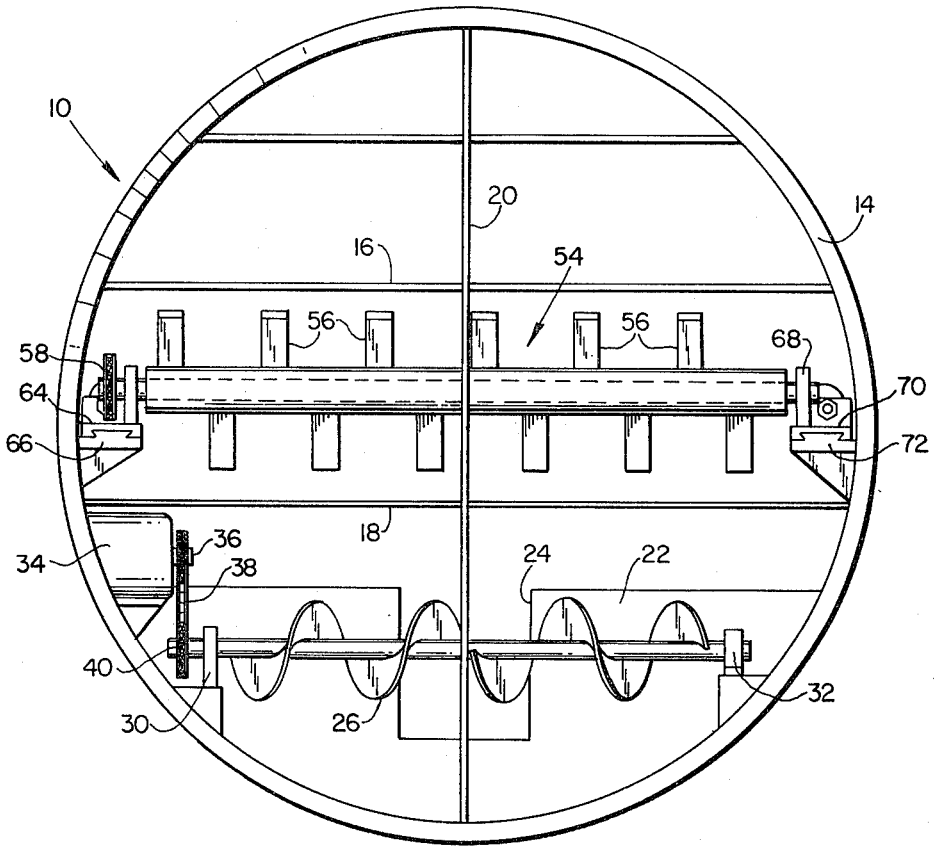
FIG. 2 is a somewhat schematic front view of the apparatus of FIG. 1.
Figure 3:
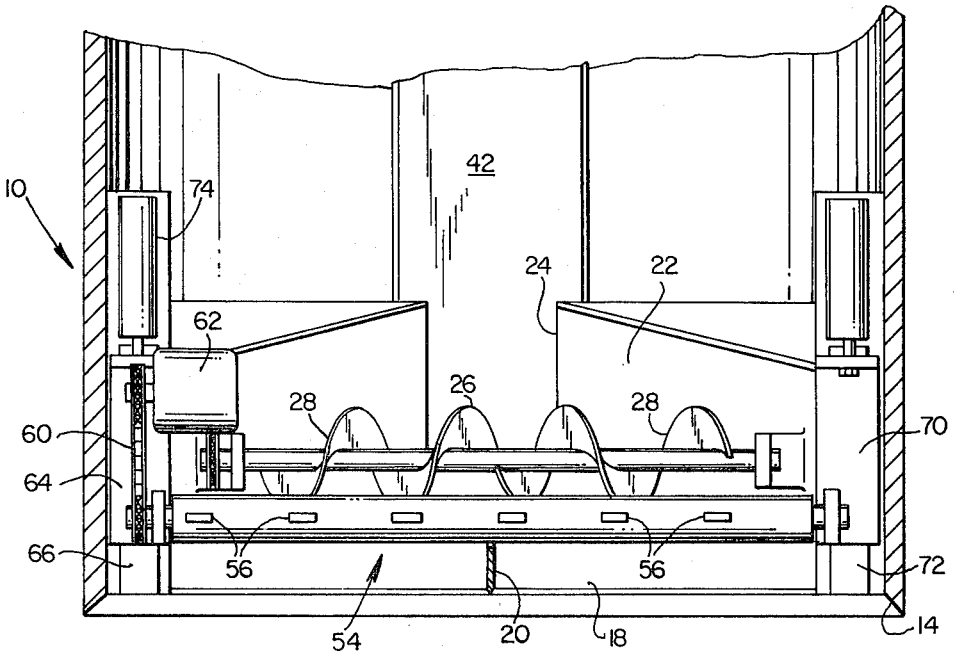
FIG. 3 is a somewhat schematic horizontal sectional view of the apparatus of FIG. 1.

In accordance with the present invention, an inclined baffle and guide member 22 is provided within the leading end portion of the cylindrical shield 10 and extends across a lower portion of the shield internally and rearwardly of the cutting edge 14. As illustrated, the baffle and guide member 22 is inclined rearwardly and upwardly with respect to a lower portion of the cutting edge 14 and the lower edge of the member 22 is arcuate to substantially fit the internal parti-circular contour of the shield 10. An opening 24 best illustrated in FIGS. 2 and 3, is provided in the baffle and guide member and is spaced upwardly and rearwardly from the lower edge of the member and approximately intermediate the ends of the member. As shown, the opening 24 takes a generally rectangular shape and is centrally located in the baffle and guide member 22.

As will be apparent, subterranean material dislodged by the cutting edge 14 will be deposited atop the baffle and guide member 22. That is, falling material will accumulate atop the baffle and guide member and material urged rightwardly by leftward advancement of the shield will also reside stop the member.

Further in accord with the invention, an auger-like member 26 is provided within the leading end portion of the shield 10 and is adapted for rotation about a substantially horizontal axis and disposed internally across the shield rearwardly of its cutting edge and above the baffle and guide member 22 adjacent the opening 24 in the member. The auger-like member 26 has first and second similar but opposite sections extending on horizontally opposite sides of the baffle opening 24 and with oppositely directed flutes 28, 28. The said opposite sections of the auger-like member tend to direct and transport dislodged subterranean material laterally and in a generally horizontal direction from opposite sides of the shield 10 toward the baffle opening 24. Thus, the material is collected and discharged through the opening 24 for further rearward transport and removal from the shield 10.

The manner in which the auger-like member 26 is operated may vary widely within the scope of the invention. As best illustrated in FIGS. 2 and 3, the member 26 is journalled at opposite ends at 30, 32 and is provided with a chain drive from a motor 34 which may be electrical, hydraulic, etc. An output element 36 from the motor 34 engages a chain drive 38 which in turn extends over and drives a suitable sprocket 40 at one end portion of the auger-like member 26.

Operation of the auger-like member 26 may be continuous during advancement of the shield 10 through the subterranean material or, alternatively, the member may be rotated only when movement of the shield has been terminated and a material removal operation commenced.

Preferably, conveyor means is provided for further transport and rearward removal of the subterranean material and an endless conveyor belt 42 is best illustrated in FIG. 1. The belt travels about front and rear pulleys 44, 46 and may be power driven from a pulley 48 by an appropriate belt or chain 50. The upper surface or upper run of the conveyor belt extends upwardly and rearwardly from a receiving end portion thereof disposed beneath the opening 24 in the baffle and guide member 22. Thus, with the upper run of the belt 42 moving rightwardly and upwardly in FIG. 1, material deposited thereon through the opening 24 will be transported upwardly and rearwardly to a discharge end of the belt which is elevated as illustrated. A wheeled cart or other receptacle 52 may be positioned as shown in FIG. 1 for the further rearward transport and removal of the subterranean material from the shield 10.

Disposed above the auger-like element 26 and substantially across the interior of the shield 10 is a rotary cutter element 54, FIG. 1. The cutter element 54 may vary widely and is illustrated as having radially extending cutting blades 56, 56, FIGS. 2 and 3. A drive means for the cutter may take the form of a sprocket 58, chain 60 and a drive motor 62 which may be of an electrical, hydraulic, or other type. Cutter 54 and its drive means are mounted on a slide 64, FIG. 1, movably horizontally along a dovetail guide 66. Similarly, an opposite end portion of the cutter 54 is supported by a journal element or bracket 68 mounted on a slide 70 movable along a dovetail guide 72. Thus, the cutter and its drive means may be moved forwardly and rearwardly between positions disposed internally within the shield 10 as illustrated in FIG. 1 as well as forward positions disposed leftwardly beyond the cutting edge 14. Preferably, a fluid operable cylinder 74 is connected in driving relationship with the slide 64 by means of a cylinder rod 76 for controlling the horizontal movement of the slide and for positioning the cutter element as desired.

As will be apparent, the rotary cutter 54 serves to further dislodge subterranean material either during leftward advancement of the shield 10 or subsequent to such advancement during periods of rest and, the materials so dislodged falls upon the auger-like member 26 and the baffle 22 for collection and removal as described above.

From the foregoing it will be apparent that a relatively simple tunneling apparatus has been provided for efficiently dislodging subterranean material and for mechanically transporting and removing the same from a cutting and/or steering shield forming a further part of the tunneling apparatus. The speed of operation of the tunneling apparatus as a whole is greatly improved and manual labor greatly reduced.

We claim:

1. In apparatus for the excavation of subterranean tunnels, the combination of a hollow cylindrical shield adapted to be axially forced through the subterranean material and having a circular cutting edge at a leading end portion, an inclined baffle and guide member extending across a lower portion of the shield internally and rearwardly of its cutting edge, the inclination of the member being rearwardly and upwardly with respect to a lower portion of the cutting edge and the lower edge of the member being arcuate to substantially fit the internal parti-circular contour of the shield, and the baffle and guide member having an opening spaced upwardly and rearwardly from its lower edge and approximately intermediate its ends, an auger-like member rotatable about a substantially horizontal axis and disposed internally across the shield rearwardly of its cutting edge and above said baffle and guide member and adjacent the opening in the member, said auger-like member having first and second similar but opposite sections extending on horizontally opposite sides of said baffle opening and with oppositely directed flutes, power means for rotating said auger-like member whereby to cause the member to transport and to direct subterranean material dislodged by said cutting edge horizontally inwardly in opposite directions for downward discharge through said baffle and guide member opening and for further transport and removal rearwardly beneath the baffle and guide member from the interior of the shield.

2. In apparatus for the excavation of subterranean tunnels, the combination as set forth in claim 1 wherein a conveyor means is provided for the rearward transport and removal of dislodged subterranean material from the interior of the shield, said conveyor means having a receiving end disposed beneath said baffle and guide member opening for the vertical deposition of dislodged material thereon and also having a rearwardly extending and material transporting surface for the removal of the material from the shield.

3. In apparatus for the excavation of subterranean tunnels, the combination as set forth in claim 2 wherein said rearwardly extending conveyor surface takes the form of an upper run of an endless conveyor belt which is directed both rearwardly and upwardly, and wherein a movable receptacle for dislodged material is provided beneath the elevated and rearwardly disposed end portion of the conveyor belt for discharge of the material into the receptacle and for further rearward transport and removal thereof.

4. In apparatus for the excavation of subterranean tunnels, the combination as set forth in claim 1 wherein a plurality of horizontal breasting plates are provided internally across the leading end portion of the shield, said plates being spaced apart vertically and having their leading edges at least approximately in the plane of the cutting edge of the shield, and said leading edges being further adapted for cutting and dislodging subterranean material as the shield is forced axially through the material.

5. In apparatus for the excavation of subterranean tunnels, the combination as set forth in claim 4 wherein at least one vertically extending breasting plate is provided in the interior of the cylindrical shield for supporting the horizontal breasting plates, and wherein the leading edge of said vertical plate is adapted for further cutting action.

6. In apparatus for the excavation of subterranean tunnels, the combination as set forth in claim 1 wherein said power means for rotating the auger-like member comprises a motor and a chain drive at one end portion of said member, said motor having a rotatable output element connected by the chain drive with the auger-like member, and said auger-like member having a rotatable element engaged with and driven by a chain extending from the motor output element.

7. In apparatus for the excavation of subterranean tunnels, the combination as set forth in claim 1 and including a horizontally extending rotatable cutter element disposed above the auger-like member and extending substantially across the leading end portion of the hollow cylindrical shield, said member being movable between positions in the interior of the shield and forwardly of the cutting edge on the shield, and associated power means for rotating said cutter element.

8. In apparatus for the excavation of subterranean tunnels, the combination as set forth in claim 7 wherein said cutter and power means are provided with a mounting slide, and wherein a support means for said slide is adapted to provide substantially horizontal forward and rearward sliding movement of the cutter and the power means in unison.

9. In apparatus for the excavation of subterranean tunnels, the combination as set forth in claim 8 and including at least one fluid operable cylinder mounted within the hollow cylindrical shield and in operative association with the slide for urging the slide, the power means and cutter forwardly and rearwardly.

10. In apparatus for the excavation of subterranean tunnels, the combination as set forth in claim 9 wherein said rotary cutter element is located vertically at approximately the mid line of the hollow cylindrical shield and extends substantially throughout the diametrical width of the shield.

* * * * *